US007246668B2

(12) United States Patent
Smith

(10) Patent No.: US 7,246,668 B2
(45) Date of Patent: Jul. 24, 2007

(54) PRESSURE ACTUATED TUBING SAFETY VALVE

(75) Inventor: Roddie R. Smith, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 295 days.

(21) Appl. No.: 10/957,240

(22) Filed: Oct. 1, 2004

(65) Prior Publication Data

US 2006/0070744 A1 Apr. 6, 2006

(51) Int. Cl.
*E21B 34/00* (2006.01)
*E21B 34/08* (2006.01)

(52) U.S. Cl. ..... 166/386; 166/332.8

(58) Field of Classification Search ..... 166/373, 166/381, 386, 321, 322, 324, 319
See application file for complete search history.

(56) References Cited

U.S. PATENT DOCUMENTS

| | | | |
|---|---|---|---|
| 3,782,461 | A | 1/1974 | Watkins |
| 3,786,867 | A | 1/1974 | Tausch et al. |
| 3,814,181 | A | 6/1974 | Young |
| 3,826,309 | A | 7/1974 | Tausch |
| 3,860,066 | A | 1/1975 | Pearce et al. |
| 4,014,386 | A | 3/1977 | Johnson et al. |
| 4,119,146 | A | 10/1978 | Taylor |
| 4,173,256 | A | 11/1979 | Kilgore |
| 4,252,197 | A | 2/1981 | Pringle |
| 4,273,186 | A | 6/1981 | Pearce et al. |
| 4,339,001 | A | 7/1982 | Paschal, Jr. |
| 4,373,587 | A | 2/1983 | Pringle |
| 4,428,557 | A | 1/1984 | Yonker et al. |
| 4,431,051 | A | 2/1984 | Adams, Jr. |
| 4,444,266 | A | 4/1984 | Pringle |
| 4,467,867 | A | 8/1984 | Baker |
| 4,469,180 | A | 9/1984 | Turner |
| 4,598,773 | A | 7/1986 | Pringle |
| 4,621,695 | A | 11/1986 | Pringle |
| 4,660,646 | A | 4/1987 | Blizzard |
| 4,664,195 | A | 5/1987 | Deaton |
| 4,911,199 | A | 3/1990 | Bontenbal et al. |
| 4,976,317 | A | 12/1990 | Leismer |
| 5,176,220 | A | 1/1993 | Akkerman |
| 5,310,004 | A | 5/1994 | Leismer |
| 5,415,237 | A | 5/1995 | Strattan |
| 5,564,501 | A | 10/1996 | Strattan et al. |
| 5,906,220 | A | 5/1999 | Thompson |
| 6,003,605 | A | 12/1999 | Dickson et al. |

FOREIGN PATENT DOCUMENTS

| | | |
|---|---|---|
| EP | 1 519 005 | 3/2005 |

OTHER PUBLICATIONS

U.K. Search Report, Application No. GB0520091.0, dated Nov. 14, 2005.

*Primary Examiner*—Jennifer H. Gay
*Assistant Examiner*—David Andrews
(74) *Attorney, Agent, or Firm*—Patterson & Sheridan, LLP

(57) ABSTRACT

The present invention generally provides a downhole valve for selectively sealing a bore. The downhole valve generally includes a closing member for seating in and closing the bore, and a pressure-actuated, retention member having first and second opposed piston surfaces for initially holding the valve in an open position but, in the event of a pressure differential between the piston surfaces, permits the closing member to operate and close the valve.

24 Claims, 6 Drawing Sheets

PRESSURE ACTUATED TUBING SAFETY VALVE

BACKGROUND OF THE INVENTION

1. Field of the Invention

Embodiments of the present invention are generally related to safety valves. More particularly, embodiments of the present invention pertain to subsurface safety valves configured to be actuated using wellbore pressure in the event of an unexpected pressure drop.

2. Description of the Related Art

Subsurface safety valves are commonly used to shut-in oil and gas wells and are typically fitted in a string of production tubing installed in a hydrocarbon producing well. The safety valves are configured to selectively seal fluid flow through the production tubing to control the flow of formation fluids upwardly should a failure or hazardous condition occur at the well surface.

Typically, subsurface safety valves are rigidly connected to the production tubing and may be installed and retrieved by conveyance means, such as tubing or wireline. During normal production, safety valves are maintained in an open position by the application of hydraulic fluid pressure transmitted to an actuating mechanism. The actuating mechanism in such embodiments may be charged by application of hydraulic pressure through hydraulic control systems. The hydraulic control systems may comprise a clean oil supplied from a surface fluid reservoir through a control line. A pump at the surface delivers regulated hydraulic fluid under pressure from the surface to the actuating mechanism through the control line. The control line resides within the annular region between the production tubing and the surrounding well casing.

In the event of a failure or hazardous condition at the well surface, fluid communication between the surface reservoir and the control line is interrupted. This, in turn, breaks the application of hydraulic pressure against the actuating mechanism. The actuating mechanism recedes within the valve, allowing a flapper to quickly and forcefully close against a corresponding annular seat—resulting in shutoff of the flow of production fluid. In many cases, the flapper can be reopened (and production flow resumed) by restoring the hydraulic fluid pressure to the actuating mechanism of the safety valve via the control lines.

For safety reasons, most surface controlled subsurface safety valves (such as the ones described above) are "normally closed" valves, i.e., the valves are in the closed position when the hydraulic pressure in the control lines is not present. The hydraulic pressure typically works against a powerful spring and/or gas charge acting through a piston. In many commercially available valve systems, the power spring is overcome by hydraulic pressure acting against the piston, producing axial movement of the piston. The piston, in turn, acts against an elongated "flow tube." In this manner, the actuating mechanism is a hydraulically actuated and axially movable piston that acts against the flow tube to move it downward within the tubing and across the flapper.

Safety valves employing control lines, as described above, have been implemented successfully for standard depth wells with reservoir pressures that are less than 15,000 psi. However, wells are being drilled deeper, and the operating pressures are increasing correspondingly. For instance, formation pressures within wells developed in some new reservoirs are approaching 30,000 psi. In such downhole environments, conventional safety valves utilizing control lines are not operable because of the effects of hydrostatic pressure on the hydraulic fluid within the control line. In other words, high-pressure wells have exceeded the capability of many existing control systems, especially hydraulic control systems which rely on control lines, which are susceptible to reliability problems.

Therefore, a need exists for a subsurface safety valve that is suitable for use in high pressure environments. There is a further need for a subsurface safety valve that does not rely on a control system that requires the use of control lines conveying hydraulic fluid to an actuating mechanism. There is yet a further need for the ability to reopen the safety valve remotely from the surface of the well.

SUMMARY OF THE INVENTION

In one respect, the present invention provides a downhole valve for selectively sealing a bore. The downhole valve generally includes a closing member for seating in and closing the bore, and a pressure-actuated, retention member having first and second opposed piston surfaces for initially holding the valve in an open position but, in the event of a pressure differential between the piston surfaces, permits the closing member to operate and close the valve.

In another respect, the present invention provides a method of operating a downhole valve. The method generally includes providing the valve in a down hole tubular, the valve having a closing member and an axially movable retention member having a first piston surface and an opposing piston surface and an interfering member to interfere with the closing member and keep the valve in the open position. A sudden pressure drop in the wellbore, shifts the retention member due to a pressure differential between the first and second piston surfaces, and closing the valve due to the axial movement of the interfering member way from the closing member.

In yet another respect, the present invention provides a safety valve for use downhole. The safety valve generally includes a pivotly mounted flapper, biased towards a closed position for sealing a bore, an interfering member to hold the flapper in an open position, a first piston surface in fluid contact with the bore, a second opposing piston surface in fluid communication with a pressure chamber having restricted fluid communication with the bore, wherein the valve is constructed and arranged to close in the event of a pressure difference between the bore and the chamber.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The apparatus and methods of the present invention allow for a subsurface safety valve for use in high pressure wells. Embodiments of the present invention provide safety valves that utilize normal wellbore pressure for actuation of the valve, which removes the need for hydraulic systems with control lines extending from the surface to the valve.

Figure 1:
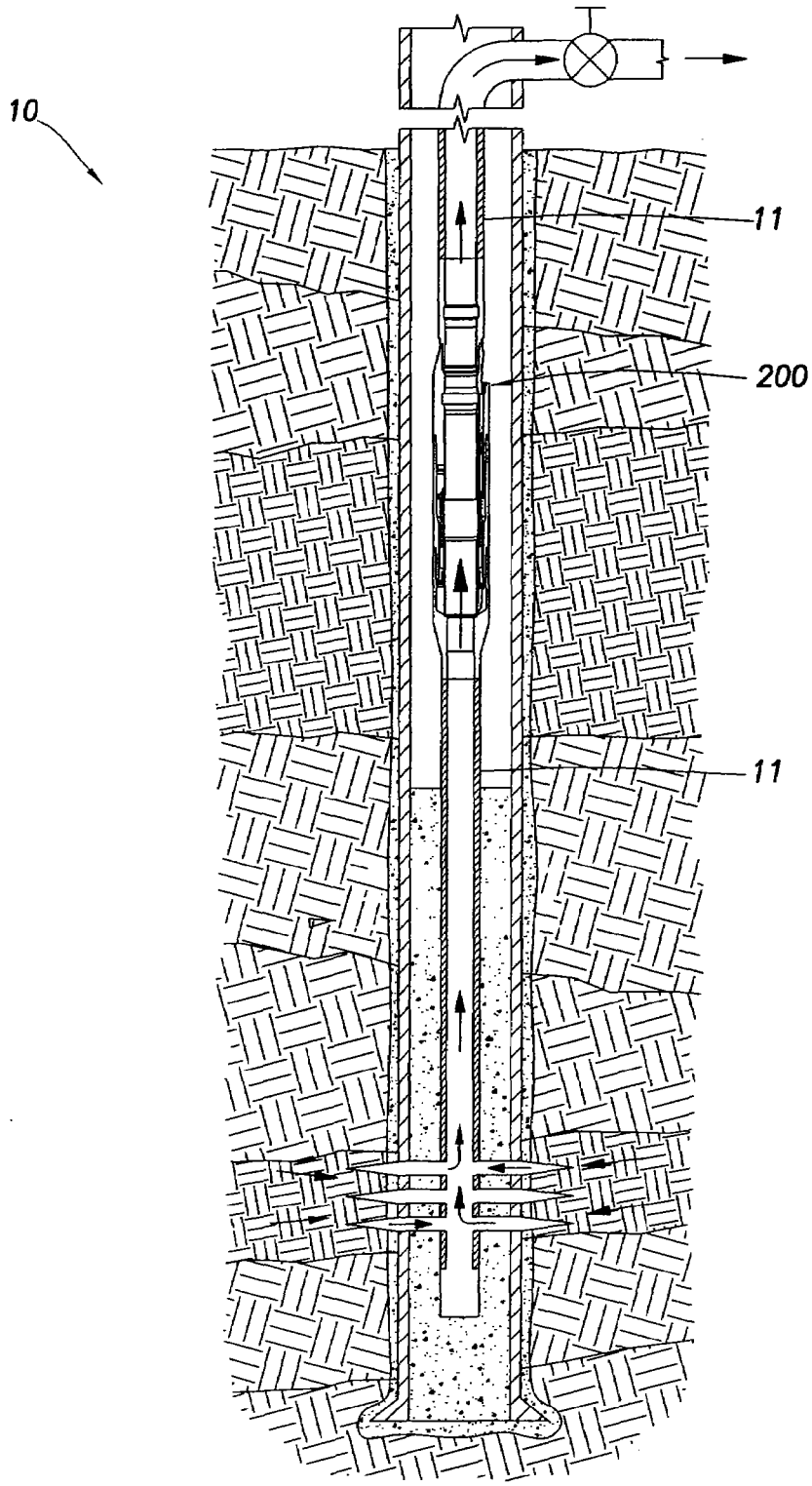
FIG. 1 is a cross-sectional view of a wellbore illustrating a string of production tubing having a subsurface safety valve in accordance with one embodiment of the present invention.

FIG. 1 is a cross-sectional view of an illustrative wellbore 10. The wellbore is completed with a string of production tubing 11. The production tubing 11 defines an elongated bore through which servicing fluid may be pumped downward and production fluid may be pumped upward. The production tubing 11 includes a safety valve 200 in accordance with one embodiment of the present invention. The safety valve 200 is used for controlling the upward flow of production fluid through the production tubing 11 in the event of a sudden and unexpected pressure loss (also referred to herein as a "pressure drop") of production fluid may coincide with a corresponding increase in flow rate within the production tubing 11. Such a condition could be due to the loss of flow control (i.e., a blowout) of the production fluid at the wellbore surface. In the event of such a condition, a subsurface safety valve, implemented according to embodiments of the current invention, automatically actuates and shuts off the upward flow of production fluid. Further, when flow control is regained at the surface, the safety valve can be remotely reopened to reestablish the flow of production fluid. Discussion of the components and operation of embodiments of the safety valve of the present invention are described below with reference to FIGS. 2A–2B, 3A–3B, and 4A–4C.

It should be understood, that as used herein, the term "production fluid" may represent both gases or liquids or a combination thereof. Those skilled in the art will recognize that production fluid is a generic term used in a number of contexts, but most commonly used to describe any fluid produced from a wellbore that is not a servicing (e.g., treatment) fluid. The characteristics and phase composition of a produced fluid vary and use of the term often implies an inexact or unknown composition.

Figure 2A:
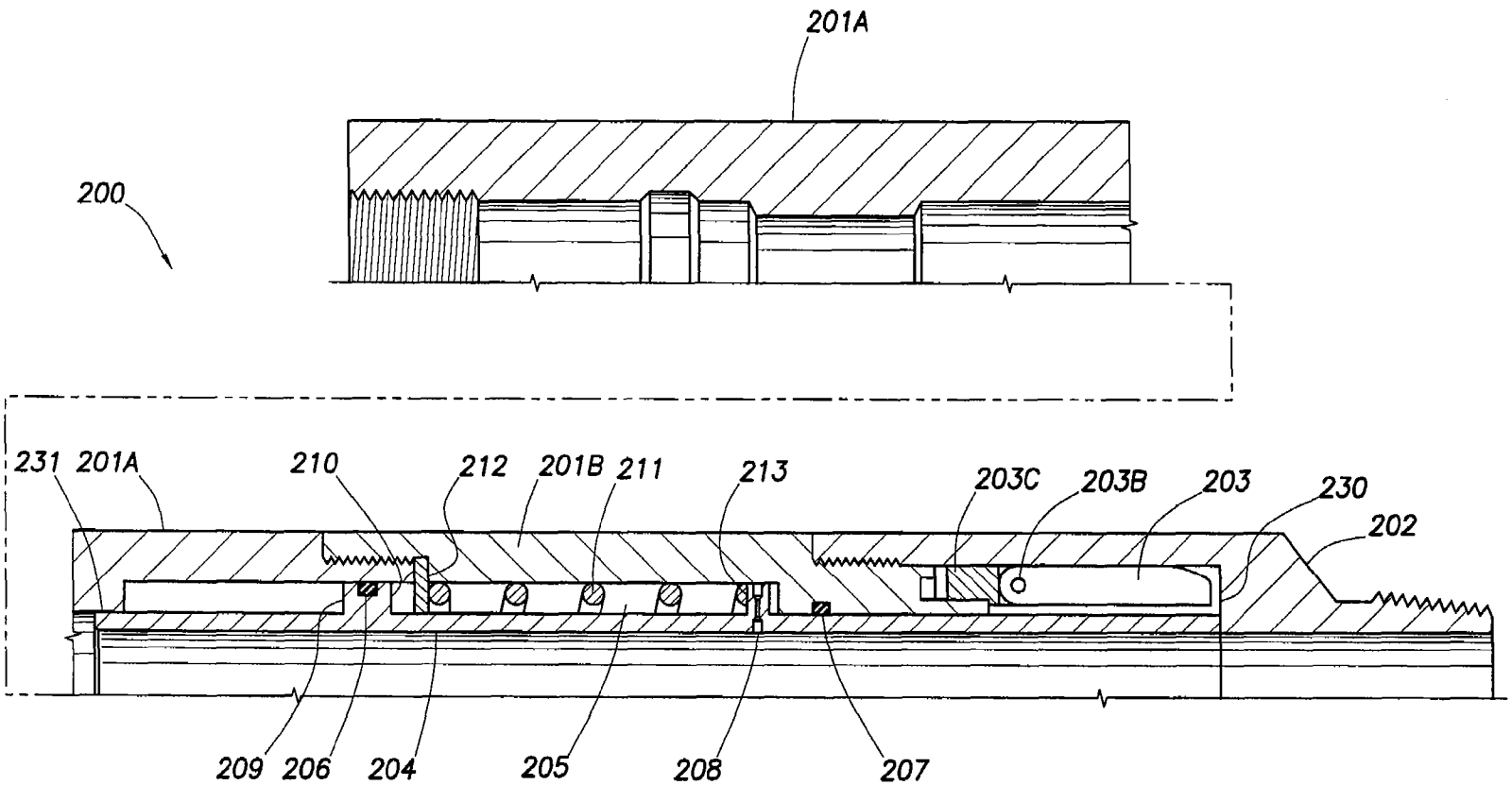
FIG. 2A is a cross-sectional view of the subsurface safety valve in an open position.

FIG. 2A illustrates a cross-sectional view of a subsurface safety valve in a open position, in accordance with one embodiment of the present invention. The safety valve 200 comprises an upper housing 201A threadedly connected to a lower housing 201B, which, in turn, is threadedly connected to a bottom sub 202. The upper housing 201A makes up the top of the safety valve 200 and extends upward. Accordingly, the bottom sub 202 makes up the bottom of the safety valve 200 and extends downward. Both the upper housing 201A and the bottom sub 202 are configured with threads to facilitate connection to production tubing 11 (or other suitable downhole tubulars) above and below the safety valve 200, respectively.

The safety valve 200 comprises a flapper 203 and a flow tube 204. The flapper 203 is rotationally attached by a pin 203B to a flapper mount 203C. The flapper 203 pivots between an open position and a closed position in response to axial movement of the flow tube 204. As shown in FIG. 2A, the flapper 203 is in the open position creating a fluid pathway through the bore of the flow tube 204, thereby allowing the flow of fluid through the valve 200. Conversely, in the closed position, the flapper 203 blocks the fluid pathway through the bore of the flow tube 204, thereby preventing the flow of fluid through the valve 200.

As stated earlier, FIG. 2A illustrates the safety valve 200 in the open position. It can be seen that the flow tube 204 is positioned such that it physically interferes with and restricts the flapper 203 from closing. As will be described with reference to FIG. 2B, when the safety valve 200 is in the closed position, the flow tube 204 is translated sufficiently upward to enable the flapper 203 to close completely and shut off flow of production fluid.

While production fluid is being conveyed to the surface under stable and controlled conditions, the safety valve 200 remains in the open position. Under such conditions, the flow tube 204 remains bottomed out against an upward facing internal shoulder 230 of the bottom sub 202, thereby restricting the flapper 203 from closing. The flow tube 204 is held in this position due to a net downward force resulting from the force exerted by a spring 211 biased towards the extended position. A gap 231 between the inner diameter of the upper mandrel 201A and the outer diameter of the flow tube 204 allows piston surface 209 to be in fluid communication with the wellbore.

As shown in FIG. 2A, a pressure chamber 205 is located in the annular space between the outer diameter of the flow tube 204 and the inner diameter of the lower housing 201B. The pressure chamber 205 is bound by a piston seal 206 on top and the tube seal 207 on bottom. A spring 211 is also located in the annular area between lower housing 201B and the flow tube 204. The spring is held in place by a spring retainer 212 and surface 213 of the flow tube 204.

During normal operation, while the valve 200 is in the open position, the pressure chamber 205 is filled with production fluid that enters the pressure chamber 205 through an orifice 208. In this embodiment, the orifice 208 is the only path for fluid to enter and exit the pressure chamber 205. The orifice is designed to meter flow that passes through it, regardless of whether the fluid is entering or exiting the pressure chamber 205. While the valve 200 is in the open position, the fluid flow through the orifice ensures that the pressure of the fluid inside the chamber is equalized with the pressure of the fluid flowing through the bore of the flow tube 204.

As shown in FIG. 2A, a pressure chamber 205 is located in the annular space between the outer diameter of the flow tube 204 and the inner diameter of the lower housing 201B. The pressure chamber 205 is bound by a piston seal 206 on top which is positioned between piston surface 209 and piston surface 210 and the tube seal 207 on bottom. A spring 211 is also located in the annular area between lower housing 201B and the flow tube 204. The spring is held in place by a spring retainer 212 and surface 213 of the flow tube 204.

Figure 2B:
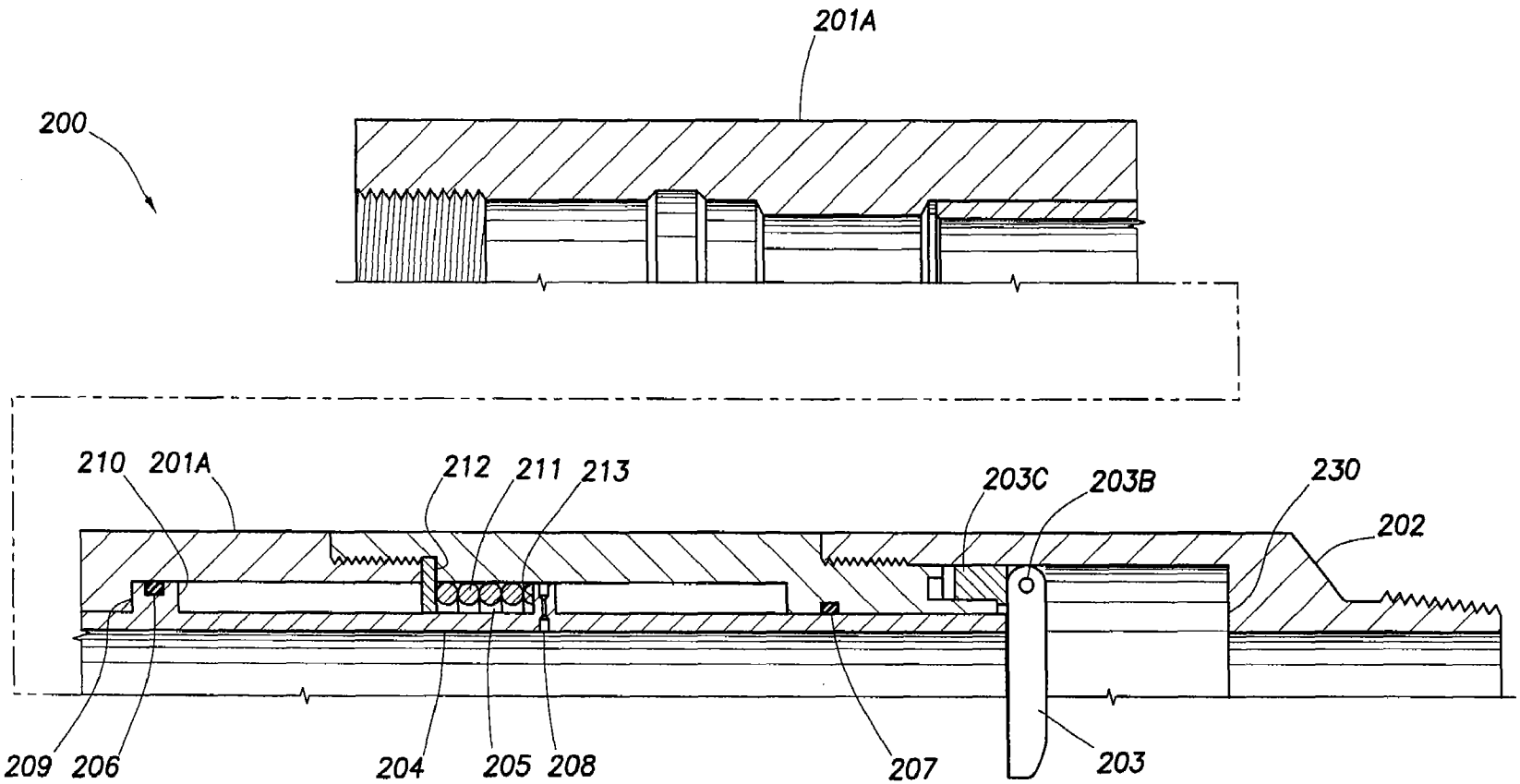
FIG. 2B is a cross-sectional view of the subsurface safety valve of FIG. 2A, shown in the closed position.

The pressure difference between the fluid within the pressure chamber 205 and the production fluid results in the pressure chamber 205 increasing in volume and the flow tube 204 being urged upward. It should be noted that as the flow tube 204 moves upward, it meets resistance as the spring 211 is compressed. Provided that the pressure difference is large enough and the pressure chamber 205 expands sufficiently, the flow tube 204 travels sufficiently upward so that it no longer restricts the flapper 203 from closing and shutting-in the well as seen in FIG. 2B.

After the flapper is closed, the pressure of the production fluid acting on the underside of the flapper 203 (pushing upward) is high enough to forceably keep the flapper 203 in the closed position. In terms of the pressure chamber 205, it should be noted that starting from the instant of the rapid pressure loss (corresponding to the loss of flow control) the metered flow of fluid through the orifice allows for the pressure equalization process to resume. However, even after the pressure equalizes again, the pressure of the downhole fluid against the bottom-side of the flapper will keep it shut.

Embodiments of the present invention also provide functionality to remotely reopen the subsurface safety valve 200. Obviously, this would be done after flow control apparatus at the surface of the wellbore are returned to working order. In order to reopen the safety valve 200 from the surface, fluid is pumped down to the safety valve 200 and the pressure is built up so that the pressure above the flapper 203 is the same as the pressure of the production fluid below the flapper 203 (i.e., pressure is equalized across the flapper 203).

It should be noted that by this time, the flow of fluid through the orifice 208 has allowed pressure of fluid within the pressure chamber 205 to again equalize with the pressure of fluid outside the pressure chamber 205. The spring 211 stays compressed, and the pressure chamber 205 does not return to it's previous volume because the flow tube 204 is not allowed to move downwards due to the closed flapper.

However, once there is equal pressure on both sides of the flapper 203, the spring 211, biased towards the extended position, will urge the flow tube 204 downwards, which in turn will push the flapper to the open position. Thereafter, the flow tube will bottom out against a corresponding interior shoulder of the bottom sub 202.

With reference to the discussion above, it can be understood that the amount of upward movement of the flow tube 204 is dependent on the difference in pressure (i.e., "pressure drop") between the fluid in the pressure chamber 205 and the pressure of the fluid flowing through the bore of the flow tube 204 at the moment of loss of flow control. In other words, the higher the difference in pressure between the fluid in the pressure chamber and the fluid flowing through the bore of the flow tube 204, the greater the amount of upward movement of the flow tube 204. Maximizing upward movement of the flow tube 204 is important because it ensures that the flow tube does not restrict the flapper 203 from fully closing in the event of a loss of flow control.

Figure 3A:
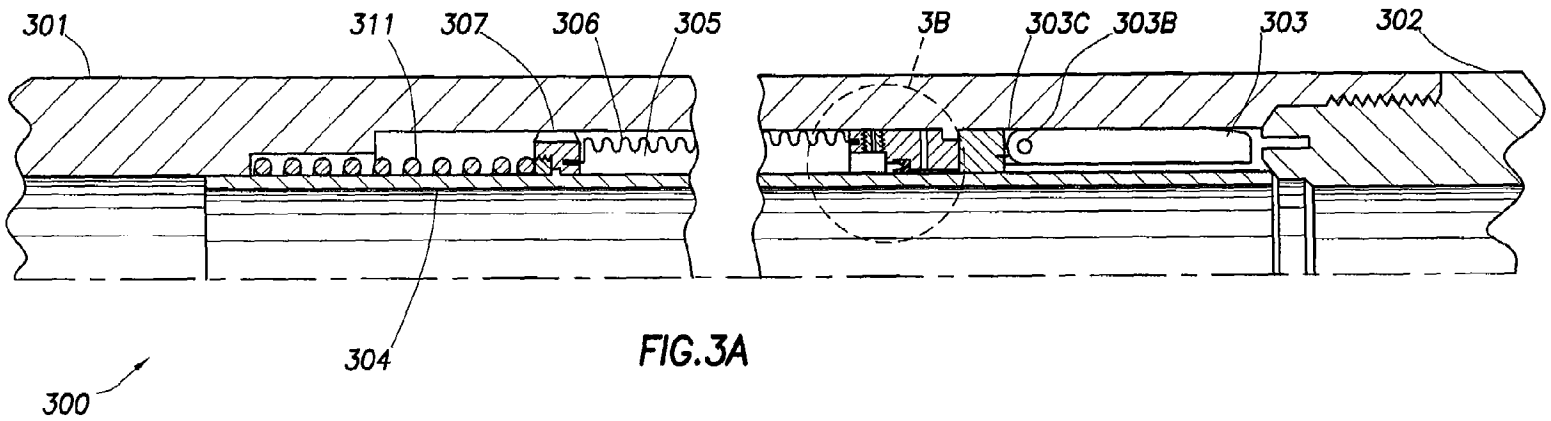
FIGS. 3A and 3B illustrate cross-sectional views of a subsurface safety valve in accordance with an alternative embodiment of the present invention.

Other embodiments of the present invention are envisioned for providing more upward movement of the flow tube for a given pressure drop. FIG. 3A, for instance, illustrates a cross-sectional view of a subsurface safety valve configured with bellows according to an alternative embodiment of the present invention. As will be described below, use of bellows for creating a pressure chamber is beneficial because bellows provide a large change in volume between the compressed and uncompressed position. Greater variance in the volume of the pressure chamber while the safety valve is in the open position versus closed position translates into more axial movement of the flow tube, which ensures complete closure of the flapper.

Referring now to FIG. 3A, a safety valve 300 is provided with a housing 301 that is threadedly connected to a bottom sub 302. Both the housing 301 and the bottom sub 302 are configured with threaded connections to allow for installing the safety valve 300 in a string of production tubing 11.

As with the embodiment described earlier, safety valve 300 comprises a flapper 303 and a flow tube 304. The flapper 303 is rotationally attached by a pin 303B to a flapper mount 303C. The flapper 303 pivots between an open position and a closed position in response to axial movement of the flow tube 304. As shown in FIG. 3A, the safety valve 300 is in the open position; the flow tube 304 restricts the flapper 303 from pivoting. However, with sufficient upward movement of the flow tube 304, the flapper 303 can pivot to block the upward flow of production fluid.

An important component of this embodiment is the use of bellows 306 for creating an expandable pressure chamber 305. The bellows 306 may be made of a variety of materials, including, but not limited to metals. For one embodiment, the bellows 306 are configured with pleated metal to facilitate a volumetric variance between its compressed and uncompressed positions.

Figure 3B:
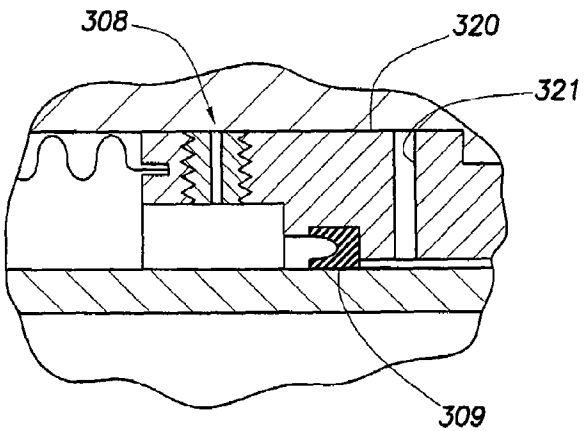

The pressure chamber 305 is defined by the annular space between the bellows 306 and the flow tube 304. The pressure chamber 305 is bound on the top by the connection between the bellows 305 and the bellows retainer 307. The lower end of the pressure chamber 305 is bound by a cap 320. There are two channels by which production fluid can enter the pressure chamber 305: fluid can go past a packing 309, or fluid can flow into the pressure chamber 305 via an orifice 308. While the valve 300 is in the open position, the fluid flow through the orifice 308 and the packing 309 ensures that the pressure of the fluid inside the pressure chamber 305 is equalized with the pressure of the fluid flowing through the bore of the flow tube 304. FIG. 3B provides a detailed view of the orifice 308 and the packing 309.

In the context of the current application, the packing 309 can be thought of as a one-way valve. As seen in FIG. 3A, the packing 309 is configured to allow fluid to flow into the pressure chamber 305, but not out of it. An orifice 308 is also provided to allow for fluid to flow into the pressure chamber 305. It should be noted that the orifice 308 provides the only path by which fluid is allowed to flow out of the chamber. The orifice 308 is configured to meter the fluid that flows through at a relatively low flow rate.

A pressure equalization port 321 extending through the cap 320 is provided to ensure that the pressure on either side of the cap 320 is equalized. Further, the port 321 provides a secondary path for production fluid to reach the packing 309 in the event that the path formed around the bottom end of the flow tube 304 and through the area adjacent to the flapper 303 is plugged.

The safety valve 300 comprises a spring 311 that resists the upward movement of the bellows retainer 307 and the flow tube 304. The bottom of the spring 311 rests against the bellows retainer 307. The top portion of the spring 311 interfaces with a downward-facing internal shoulder of the housing 301. In the open position of the safety valve 300, with the flow tube 304 bottomed out, the spring 311 is fully extended. In the closed position of the safety valve 300, with the flow tube 304 all the way up, the spring 311 is compressed and it exerts a downward force against the bellows retainer 307.

In the event of a loss of flow control at the surface of the wellbore, there would be a pressure drop between the fluid flowing through the bore of the flow tube 304 and the fluid in the pressure chamber 305. As with the previous embodiment, the pressure in the pressure chamber 305 is not reduced in concert with the pressure of the production flow because the metering effect of the orifice 308 does not allow the fluid to flow out of the pressure chamber 305 to allow for pressure equalization to occur immediately. As a result, the pressure chamber 305 expands by extending the bellows 306 axially, which, in turn, urges the bellows retainer 307 and flow tube 304 to move upward, compressing the spring 311. Upon sufficient upward movement of the flow tube 304, the flapper 303 will close to shut-in the wellbore.

As with the embodiment described earlier with reference to FIGS. 2A and 2B, the valve can be reopened by equalizing pressure on both sides of the flapper 303 and allowing the spring 311 to urge the flow tube 304 downwards. This, in turn, would return the flapper 303 to the open position.

Figure 4B:
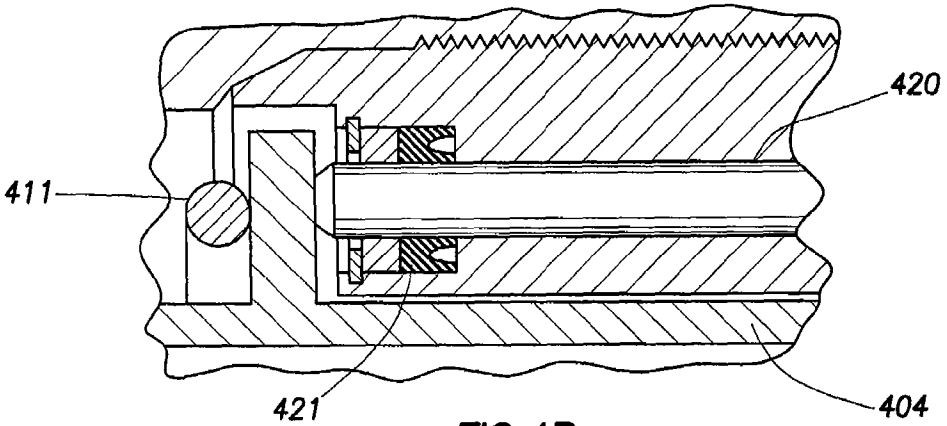
FIGS. 4A–4C illustrate cross-sectional views of a subsurface safety valve in accordance with yet another embodiment of the present invention.
Figure 4A:
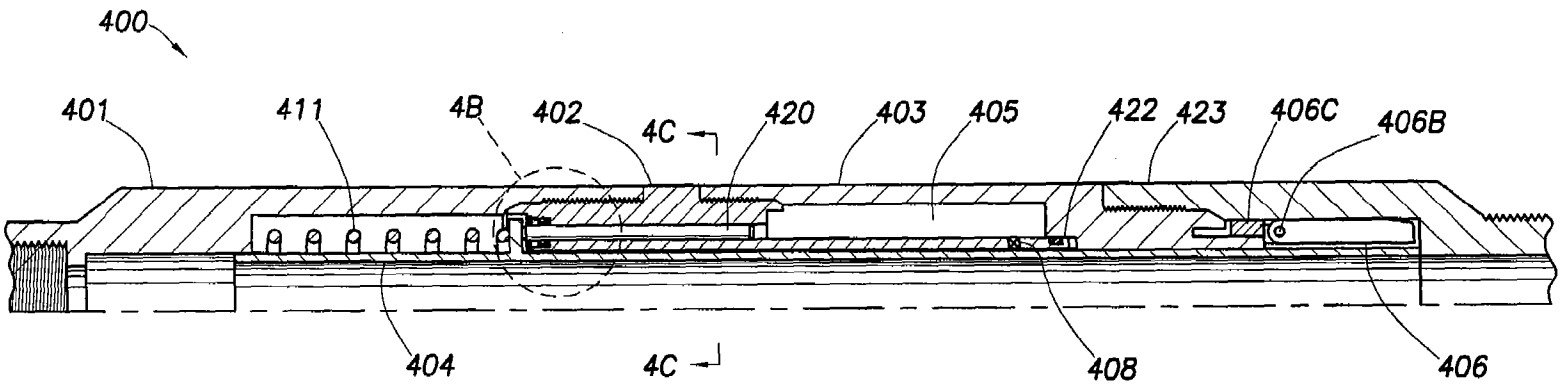

FIG. 4A illustrates yet another embodiment of the present invention that is designed to provide additional axial movement of the flow tube for a given pressure drop. A cross-sectional view of a subsurface safety valve configured with extension rods sliding in their corresponding cylinders is provided. As will be described below, the axial movement of rods for expanding a pressure chamber is beneficial because the process of displacing rods in cylinders with fluid can yield a tremendous amount of axial movement of a flow tube for a given pressure drop. As stated earlier, complete upward movement of the flow tube ensures complete closure of the flapper.

Referring now to FIG. 4A, a safety valve 400 is provided with a housing 401 that is threadedly connected to a crossover sub 402, which is threadedly connected to a lower housing 403. The lower housing 403 is connected to a bottom sub 404. Both the housing 401 and the bottom sub 404 are configured with threaded connections to allow for installing the safety valve 400 in a string of production tubing 11. As with previously described embodiments, the safety valve 400 includes a flow tube 404, spring 411 and flapper 406, each of which provides generally the same functionality as with other embodiments described above.

The lower end 422 of the crossover sub 402 seals into the lower housing 403 at position 422. It should be understood that because the lower end 422 of the crossover sub 402 is sealingly connected (e.g., press fit, static seal, etc.) to the lower housing 404, production fluid is not able to flow past the seal between the lower end 422 of the crossover Sub 402 and the lower housing 404. However, the lower end 422 of the crossover sub 402 does contain an orifice 408 that allows fluid to flow into and out of a pressure chamber 405. Fluid arrives at the orifice 408 by flowing around the top or bottom of the flow tube 404 and within the annular space between the lower end 422 of the crossover sub 402 and flow tube 404.

Referring now to FIG. 4A, a safety valve 400 is provided with a housing 401 that is threadedly connected to a crossover sub 402, which is threadedly connected to a lower housing 403. The lower housing 403 is connected to a bottom sub 423. Both the housing 401 and the bottom sub 423 are configured with threaded connections to allow for installing the safety valve 400 in a string of production tubing 11. As with previously described embodiments, the safety valve 400 includes a flow tube 404, spring 411 and flapper 406 which is rotationally attached by a pin 406B to a flapper mount 406C, each of which provides generally the same functionality as with other embodiments described above.

The lower end 422 of the crossover sub 402 seals into the lower housing 403 at position 422. It should be understood that because the lower end 422 of the crossover sub 402 is sealingly connected (e.g., press fit, static seal, etc.) to the lower housing 403, production fluid is not able to flow past the seal between the lower end 422 of the crossover Sub 402 and the lower housing 403. However, the lower end 422 of the crossover sub 402 does contain an orifice 408 that allows fluid to flow into and out of a pressure chamber 405. Fluid arrives at the orifice 408 by flowing around the top or bottom of the flow tube 404 and within the annular space between the lower end 422 of the crossover sub 402 and flow tube 404.

In the event of a sudden pressure drop, the fluid is not capable of immediately exiting the pressure chamber via the orifice 408 (for purposes of pressure equalization), so the pressure in pressure chamber 405 is higher than the pressure of the flowing production fluid. Consequently, the pressure chamber 405 expands and displaces the rods 421 upward from the cylinders. The rods 420 move the flow tube 404 upward against the spring 411. After the flow tube 404 has moved sufficiently upward, the flapper 403 closes and shuts-in the well.

Figure 4C:
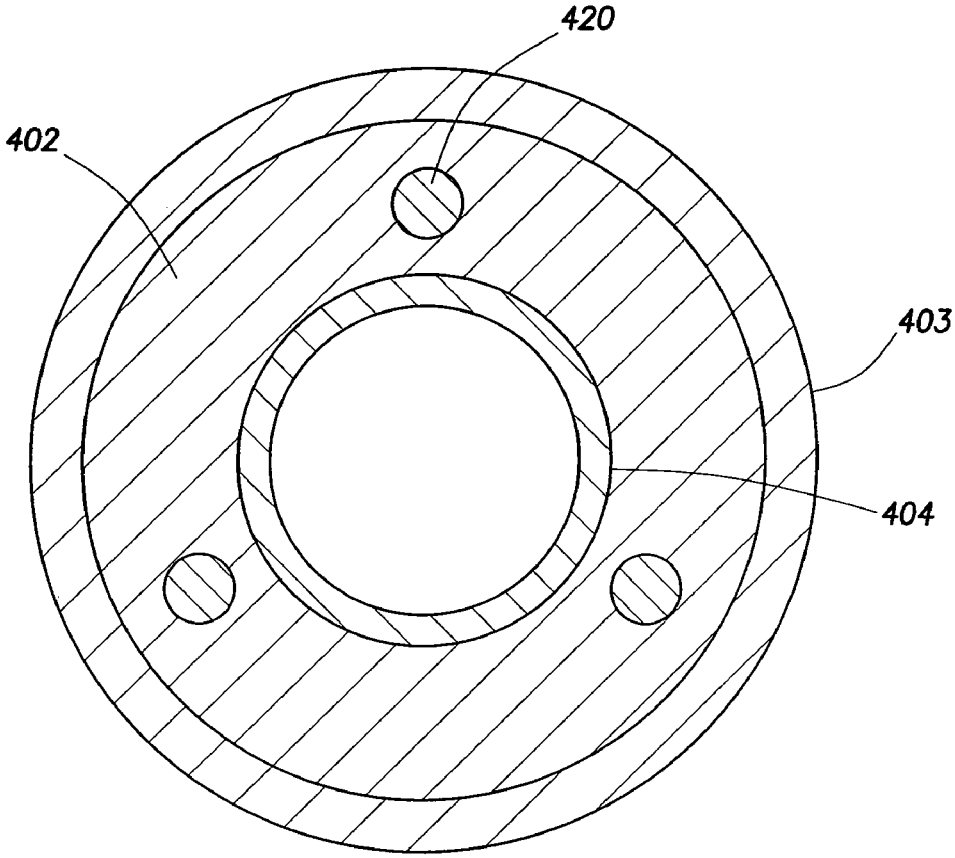

It can be seen from FIG. 4C that the collective cross-sectional area of rods 420 is considerably less than the annular area between the inner diameter of the lower housing 403 and the lower end of the crossover sub 402. Accordingly, the use of rods 420 in this manner requires less expansion of pressure chamber 405 to achieve the required amount of axial movement of the flow tube 404 to allow the flapper 403 to close. This is because the volumetric change of the pressure chamber 405 need only be enough to displace the volume of the rods 420, rather than the entire annular area between the lower mandrel and the sleeve 409. While three rods 420 are shown for the current embodiment, it should be understood that the number of rods can vary based on the requirements of a particular implementation.

Those skilled in the art will recognize that safety valves according to embodiments of the present invention may be utilized in any wellbore implementation where a pressure differential (i.e. pressure drop) may arise. For instance, the safety valves described herein are fully functional if there is a pressure differential between fluid in the pressure chamber and fluid flowing through the bore of the safety valve, regardless of the absolute pressures of the respective fluids. Therefore, safety valves according to embodiments of the present invention may be utilized in low pressure wellbores as well as high pressure wellbores.

While the exemplary safety valves described herein are configured for use with production tubing, those skilled in the art will acknowledge that embodiments of the present invention may be configured for use in a variety of wellbore implementations. For example, some embodiments of the present invention may be implemented as safety valves configured for use with wireline. Yet other embodiments may be configured for use with drill pipe or coiled tubing.

While the foregoing is directed to embodiments of the present invention, other and further embodiments of the invention may be devised without departing from the basic scope thereof, and the scope thereof is determined by the claims that follow.

The invention claimed is:

1. A downhole valve for selectively sealing a bore, comprising:

a closing member for seating in and closing the bore; and a pressure-actuated retention member having first and second piston surfaces, wherein the event of a pressure differential between the piston surfaces, the retention member moves and permits the closing member to close the valve and wherein the first piston surface is in fluid communication with the bore via a first flow path that traverses a wall of the retention member and the second piston surface is in fluid communication with the bore via a second flow path through the wall of the retention member, whereby the second flow path is axially displaced from the first flow path.

2. The downhole valve of claim 1, wherein the retention member physically interferes with the closing member to keep the closing member in the open position.

3. The downhole valve of claim 2, wherein in the event of the pressure differential, the retention member moves to a location wherein it no longer interferes with the closing member and the closing member is permitted to close.

4. The downhole valve of claim 3, wherein movement of the retention member is due to a relatively greater force on the second piston surface immediately following a pressure drop in the wellbore.

5. The downhole valve of claim 4, wherein the first piston surface is in fluid communication with a wellbore pressure.

6. The downhole valve of claim 5, wherein a second piston surface is in metered fluid communication with the wellbore pressure.

7. The downhole valve of claim 6, wherein the metered fluid communication is through a bidirectional metering device between the second piston surface and the wellbore, the device restricting the flow of fluid to a chamber housing the second piston surface.

8. The downhole valve of claim 7, wherein the chamber further includes a mechanical biasing member constructed and arranged to bias the retention member into interference with the closing member under normal conditions.

9. A method of operating a downhole valve, comprising:

providing the valve in a downhole tubular, the valve having a bore, a closing member, an axially movable retention member having a first piston surface in fluid communication with the bore via a first flow path and a second piston surface in fluid communication with the bore via a second flow path;

creating a pressure drop in the wellbore;

establishing a first flow rate through the first flow path from the bore;

establishing a second flow rate through the second flow path from the bore, wherein the second flow rate is not dependent on the first flow rate;

shifting the retention member due to a pressure differential between the first and second piston surfaces brought about by a difference between the first and the second flow rates; and closing the valve due to the axial movement of the retention member away from the closing member.

10. The method of claim 9, wherein the closing member is a pivotly mounted flapper biased towards the closed position.

11. A safety valve for use downhole comprising:

a pivotly mounted flapper, biased towards a closed position for sealing a bore;

an interfering member to hold the flapper in an open position;

a first piston surface in fluid communication with the bore via a first flow path that traverses a wall of the interfering member; and a second piston surface in fluid contact with a pressure chamber, the pressure chamber in fluid communication with the bore via a second flow path through the wall of the interfering member, whereby the second flow path is axially displaced from the first flow path;

wherein the valve is constructed and arranged to close in the event of a pressure difference between the bore and the chamber.

12. The safety valve of claim 11, wherein the safety valve is a subsurface safety valve configured to control the flow of hydrocarbons consisting of a gas, liquid or combinations of both.

13. The safety valve of claim 11, wherein the pressure in the pressure chamber is substantially the same as pressure within the bore of the interfering member when the flapper is in the open position.

14. The safety valve of claim 11, wherein the pressure in the pressure chamber is substantially higher in the pressure chamber than in the bore of the interfering member when the flapper is in a closed position.

15. The safety valve of claim 11, wherein fluid flows into and out of the pressure chamber via an orifice which is configured to meter fluid flow into and out of the pressure chamber.

16. The safety valve of claim 11, wherein the pressure chamber is defined by an annular volume bound at the top and the bottom by seals.

17. The safety valve of claim 11, wherein the pressure chamber is defined by an annular volume bound by bellows.

18. The safety valve of claim 17, wherein the bellows are constructed of metal.

19. The safety valve of claim 11, wherein fluid flows into the pressure chamber by bypassing a seal configured to permit one-way fluid flow.

20. The safety valve of claim 11, wherein the safety valve is conveyed downhole using wireline.

21. The safety valve of claim 11, wherein the safety valve is conveyed downhole using drill pipe.

22. The safety valve of claim 11, wherein the safety valve is conveyed downhole using coiled tubing.

23. A method for controlling fluid flow in a wellbore, comprising:

placing a safety valve in series with a string of production tubing, the production tubing having a bore there through, and the safety valve comprising: a tubular housing;

a pressure chamber;

a flow tube movably disposed along a portion of the bore, the flow tube having a first piston surface in fluid communication with the bore via a first flow path and a second piston surface in fluid communication with the bore via a second flow path; and a flapper pivotally movable between an open position and a closed position in response to the longitudinal movement of the flow tube; running the production tubing and safety valve into the wellbore;

placing the flapper in the open position;

establishing a first flow rate through the first flow path and a second flow rate through the second flow path, wherein the flow rates are independent of each other; and moving the flow tube in response to a difference between the first flow rate and the second flow rate.

24. The method of 23, further comprising responding to an increase in flow rate of fluid flowing to a surface of the wellbore by placing the flapper in the closed position.

* * * * *